US009140060B2

(12) United States Patent
Lin

(10) Patent No.: US 9,140,060 B2
(45) Date of Patent: Sep. 22, 2015

(54) WINDOW COVERING HAVING AT LEAST ONE DEFORMABLE CONNECTOR

(75) Inventor: Tzong Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 1765 days.

(21) Appl. No.: 12/184,287

(22) Filed: Aug. 1, 2008

(65) Prior Publication Data

US 2010/0024994 A1 Feb. 4, 2010

(51) Int. Cl.
*E06B 9/322* (2006.01)
*E06B 9/262* (2006.01)

(52) U.S. Cl.
CPC *E06B 9/322* (2013.01); *E06B 9/262* (2013.01)

(58) Field of Classification Search
USPC ..... 160/170, 171, 168.1 R
See application file for complete search history.

(56) References Cited

U.S. PATENT DOCUMENTS

| | | | | |
|---|---|---|---|---|
| 13,251 | A | 7/1855 | Bixler | |
| 2,687,769 | A | 8/1954 | Gershuny | |
| 3,403,427 | A * | 10/1968 | Asseo et al. | 24/304 |
| 5,193,601 | A | 3/1993 | Corey et al. | |
| 5,482,750 | A | 1/1996 | Colson et al. | |
| 6,079,471 | A | 6/2000 | Kuhar | |
| 6,234,236 | B1 | 5/2001 | Kuhar | |
| 6,325,131 | B1 | 12/2001 | Dekker et al. | |
| 6,644,372 | B2 | 11/2003 | Judkins | |
| 6,837,294 | B2 | 1/2005 | Cheng et al. | |
| 6,991,020 | B1 | 1/2006 | Cheng et al. | |
| 7,159,634 | B1 | 1/2007 | Judkins | |
| 2004/0129390 | A1 | 7/2004 | Toti | |
| 2004/0154758 | A1 * | 8/2004 | Cheng et al. | 160/170 |
| 2007/0163727 | A1 * | 7/2007 | Cheng et al. | 160/170 |

* cited by examiner

*Primary Examiner* — Katherine Mitchell
*Assistant Examiner* — Abe Massad
(74) *Attorney, Agent, or Firm* — Buchanan Ingersoll & Rooney PC

(57) ABSTRACT

A window covering is disclosed that includes a first rail, window covering material adjacent the first rail, at least one lift cord extending through the window covering material to the headrail, a plurality of pulleys positioned adjacent the first rail, at least one spring motor adjacent the first rail, at least one spring motor cord extending from the one or more spring motors and a deformable connector attached to one or more spring motor cords and one or more lift cords. The connector is deformable to a size and shape sufficient for the connector and one or more spring motor cords to pass along at least one of the pulleys during movement along a cord path defined by one or more of the pulleys.

15 Claims, 8 Drawing Sheets

WINDOW COVERING HAVING AT LEAST ONE DEFORMABLE CONNECTOR

FIELD OF INVENTION

The invention relates to window coverings.

BACKGROUND OF THE INVENTION

Window coverings, such as venetian blinds, roman shades, cellular shades or pleated shades, often have a headrail, a bottom rail and window covering material between the headrail and the bottom rail. U.S. Pat. Nos. 13,251, 2,687,769, 5,193,601, 5,482,750, 6,234,236, 6,325,131, 6,644,372, and 7,159,634 and U.S. Patent Application Publication Nos. 2007/0163727, 2004/0129390 disclose examples of such window coverings. Window coverings are typically mounted adjacent a window and are used to cover the window and provide a desired aesthetic effect to the interior and exterior of a home, office or other building. The window covering material is often moveable from a retracted position adjacent the headrail to various extended positions that lower the bottom rail and permit the window covering material to cover a window.

Various different lift systems can be used to permit a user to adjust the position of the window covering material. For example, U.S. Pat. No. 6,991,020 to Cheng et al. discloses a window covering that utilizes a cord lock and an operator cord that extends through the cord lock and is attached to lift cords. The operator cord extends out of the cord lock and may be manipulated by a user to adjust the position of the window covering.

U.S. Pat. No. 6,837,294 to Cheng et al. provides a similar disclosure to U.S. Pat. No. 6,991,020 and also discloses a cordless shade that utilizes a spring motor that includes two spring motor cord spools attached to respective spring motor cord spools. A spring motor cold is entrained about the spring motor cord spools and is attached to lift cords. A user adjusts the position of the window covering material by providing a downward force to the bottom rail of the window covering to extend the window covering material or an upward force to the bottom rail to permit the spring motor to retract the lift cords and the window covering material.

In both U.S. Pat. Nos. 6,991,020 and 6,837,294, Cheng et al. teach that the attachment of the spring motor cord or operator cord to the lift cords should not pass over any pulley to avoid entanglement of the cords that may cause "hang up" problems that may make moving the window covering material problematic for a user. (See e.g. U.S. Pat. No 6,991,020, Col. 3, lines 46-55). Such binding may result in a user having to exert a substantial force to extend the window coveting material. Sometimes, such forces can cause the attachment between the cords to break or cause other damage to the window covering. These "hang up" problems can also result in a non-level window covering due to the entanglement of the colds, which often produces an undesirable aesthetic effect.

Further, the need for the attachment of the cords in the lift systems disclosed by Cheng et al. to not pass over a pulley limits the extent to which the window covering material may be extended below the headrail to, at most, the length of the headrail. If the full length of the headrail is filled with colds, spools and spring motor to provide a maximum length of the window covering, the window covering cannot be used in stock window covering programs or cut down programs. In these programs, window coverings are made in a limited number of stock sizes, which may then be cut down by a retailer to fit a specific window opening dimension provided by a customer.

Cut down programs typically offer blinds or shades for lower prices relative to custom made window coverings because a retailer is able to take advantage of economies of scale involved in the production of the limited number of available stock sized window coverings. Window coverings that can only provide a length of extended window covering material that is relatively equivalent to the length of a headrail typically cannot provide the window covering material length necessary for use in one or more stock blinds of window covering cut down programs.

U.S. Patent Application No. 2004/0129390 discloses a window covering that includes lift cords connected to a spring motor by various interlocking gears or other transmission systems. Such interlocking gears or transmission systems can be expensive to manufacture. Moreover, such lift systems often require precise fabrication due to the need for the various interlocking components to reliably interact with each other. Often, only very large window coverings, which are typically much heavier and costlier than other window coverings, may economically include such systems and still be produced efficiently enough to meet the price expectations of a customer.

A window covering is needed that includes a connection between one or more lift cords and one or more operator cords or spring motor cords that reduces, if not completely eliminates, cord entanglement problems or "hang up" problems so that the connection of the cords may reliably pass over, or pass along, one or more pulleys in a window covering lift system. Preferably, such a connection does not require interlocking gears or other expensive or complicated mechanisms to provide a cost effective solution to such cord entanglement or "hang up" problems.

SUMMARY OF THE INVENTION

I provide a window covering that includes a first rail, window covering material adjacent the first rail, one or more lift cords, multiple pulleys positioned adjacent the first rail, at least one lift system adjacent the first rail, one or more lift system cords extending from the one or more lift systems and a deformable connector attached to the one or more lift system cords and the one or more lift cords. The window covering material is moveable from a retracted position to an extended position. The one or more lift system cords are configured to extend away from the one or more lift systems and travel along a path defined by at least one of the pulleys when the window covering material is raised or lowered. The deformable connector is sized and configured to permit the one or more lift system cords, connector and a portion of the one or more lift cords to pass over at least one of the pulleys during movement along the path. The connector is configured to assume a curved shape as the connector passes over at least one of the plurality of pulleys.

Other embodiments of my window covering may include a lift system that is one or more spring motors or a cord lock. For embodiments of my window covering that utilize a cord lock, the lift system may also include one or more operator cords. The one or more operator cords include a first portion that passes through the cord lock and is attached to the connector. The first portion of the one or more operator cords may be a portion of a lift cord control mechanism cord. A user may raise or lower the blind by manipulating the operator cord. The first portion of the one or more operator cords move along the path defined by at least one of the pulleys when the window covering material is raised or lowered. In embodiments of my window covering that utilize one or more spring motors the one or more lift cord control mechanism cords may be one or more spring motor cords that extend from the one or more spring motors.

The deformable connector may be a ring having a generally oval shaped body or a generally circular body. Of course, the deformable connector may also have other shapes. Preferably, the deformable connector is composed of rubber or plastic.

In some embodiments of my window covering, the connector may be configured to deform to a first length when the connector is not passing along the surface of any of the pulleys and is configured to deform to a second length that is greater than the first length when the connector passes along the surface of any of the pulleys.

The plurality of pulleys may include three pulleys that are aligned with each other adjacent one end of the first rail and three other pulleys that are aligned with each other adjacent the opposite end of the first rail. Preferably, a pulley mount is positioned adjacent each end of the first rail and is configured to mount the three pulleys adjacent each end of the first rail. Of course, other pulley alignments or arrangements may also be used in embodiments of my window covering.

Other details, objects and advantages of the invention will become apparent as the following description of certain present preferred embodiments thereof and certain present preferred methods of practicing the same proceeds.

BRIEF DESCRIPTION OF THE DRAWINGS

Present preferred embodiments of the invention are shown in the accompanying drawings and certain present preferred methods of practicing the same are also illustrated therein, in which.

DESCRIPTION OF PRESENT PREFERRED EMBODIMENTS

Figure 1:
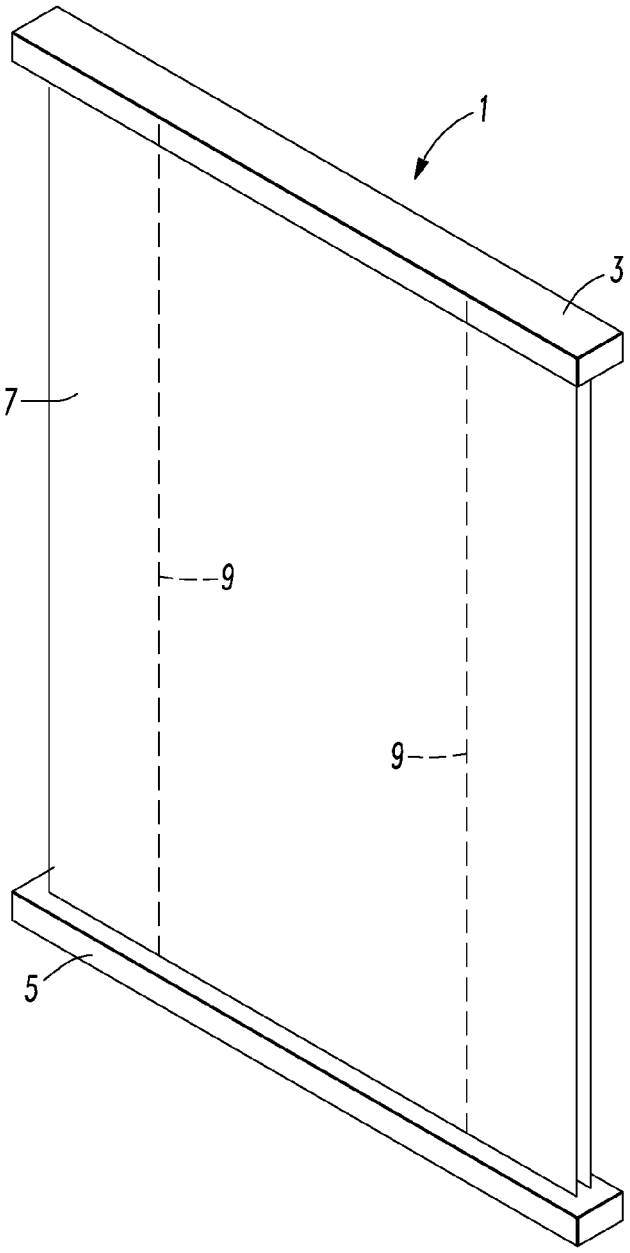
FIG. 1 is a perspective view of a first present preferred embodiment of my window covering illustrating the window covering material in an extended position.

Referring to FIG. 1, a first present preferred embodiment of my window covering 1 includes a headrail 3, a bottom rail 5, window covering material 7 positioned between the headrail 3 and bottom rail 5. A lift cord 9 has a first end attached to the bottom rail adjacent one end of the bottom rail 5 and a second end attached to the bottom rail adjacent the opposite end of the bottom rail 5. The lift cord 9 extends through the window covering material and into the headrail 3.

The headrail 3 houses a lift system. The lift system includes a spring motor 15 that is operatively connected to the lift cord 9. The spring motor 15 includes a first spool 19 and a second spool 21. A spring 17 is connected to both spools 19 and 21 and is configured to rotate the spools 19 and 21. The spring motor 15 also includes a spring motor cord 11 that is attached to a spool (not shown) such that the spools 19 and 21 rotate when the spring motor cord 11 is extended or retracted from this spool. During retraction of the spring motor cord 11, the spring motor cord 11 may be wound about the spool. During extension of the spring motor cord 11, the spring motor cord 11 may be unwound from the spool.

It should be appreciated that the spring motor 15 may be any type of spring motor or interconnected spring motors known to those skilled in the art. For example, spring motors of the type disclosed in U.S. Pat. No. 6,234,236 or other spring motors may be used in embodiments of my window covering.

Figure 2:
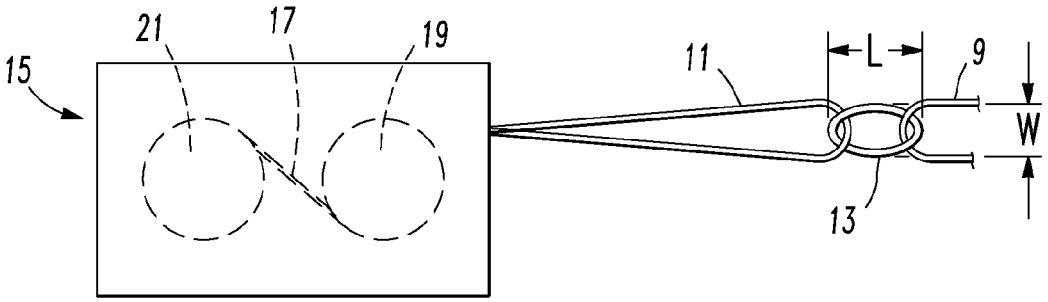
FIG. 2 is a fragmentary view of the first present preferred embodiment illustrating the spring motor cord and lift cord attached to the connector.

As may be best appreciated from FIG. 2, the spring motor cord 11 is attached to a first end of a deformable connector 13. The deformable connector 13 is also attached to a middle portion of the lift cord 9. Preferably, the spring motor cord 11 and lift cord 9 are looped about opposite ends of the connector 13 to attach those cords to the connector 13. The lift cord 9 and spring motor cord 11 exert forces that act on opposite ends of the connector 13, which deforms the connector so it is stretched to a length L and a width W. The width W is sufficiently narrow to permit the connector to pass over a pulley.

Figure 3:
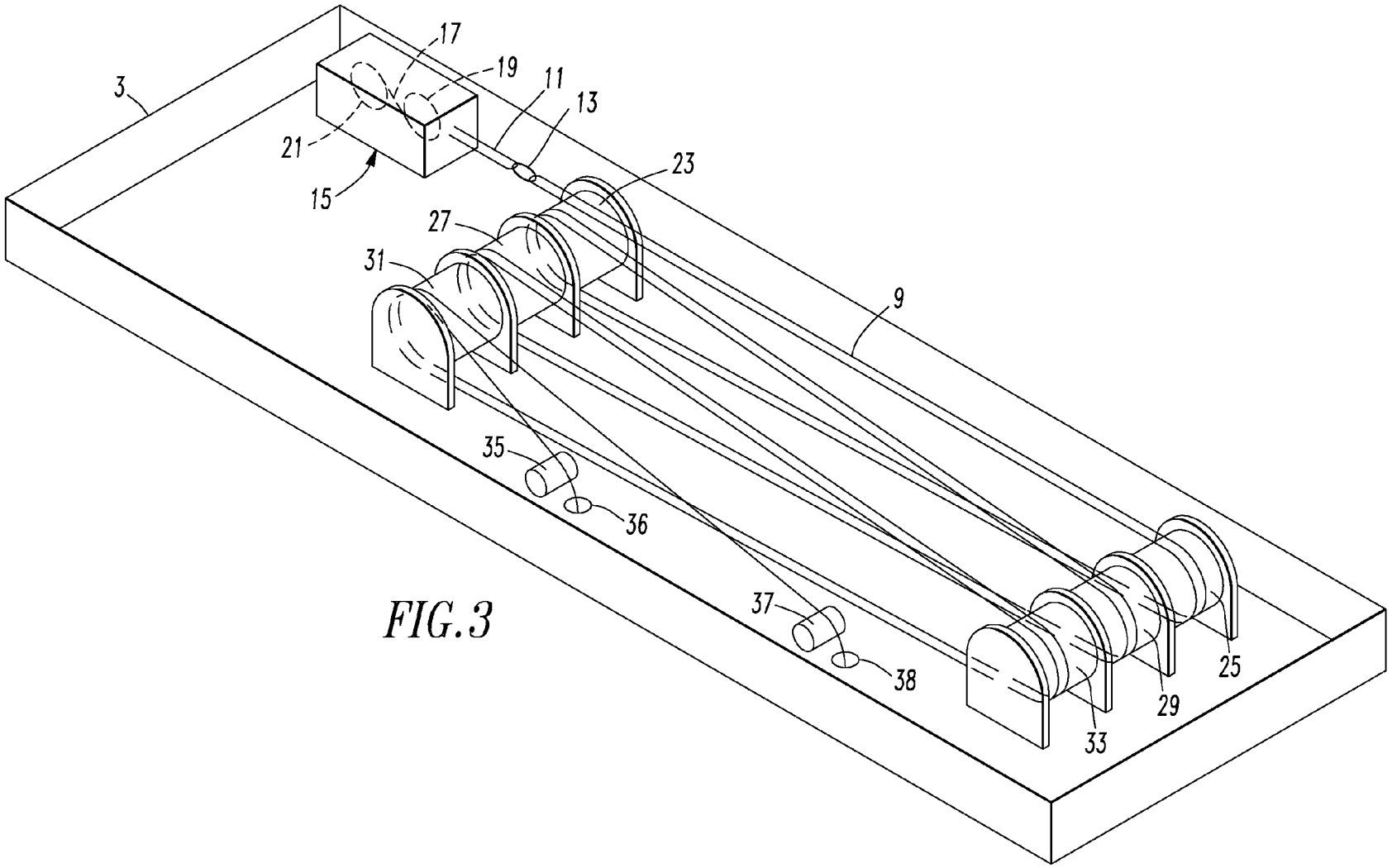
FIG. 3 is a top perspective view of the first present preferred embodiment illustrating the pulleys, spring motor, first present preferred deformable connector and cord path wherein a portion of the cord path is shown in chain line.
Figure 4:
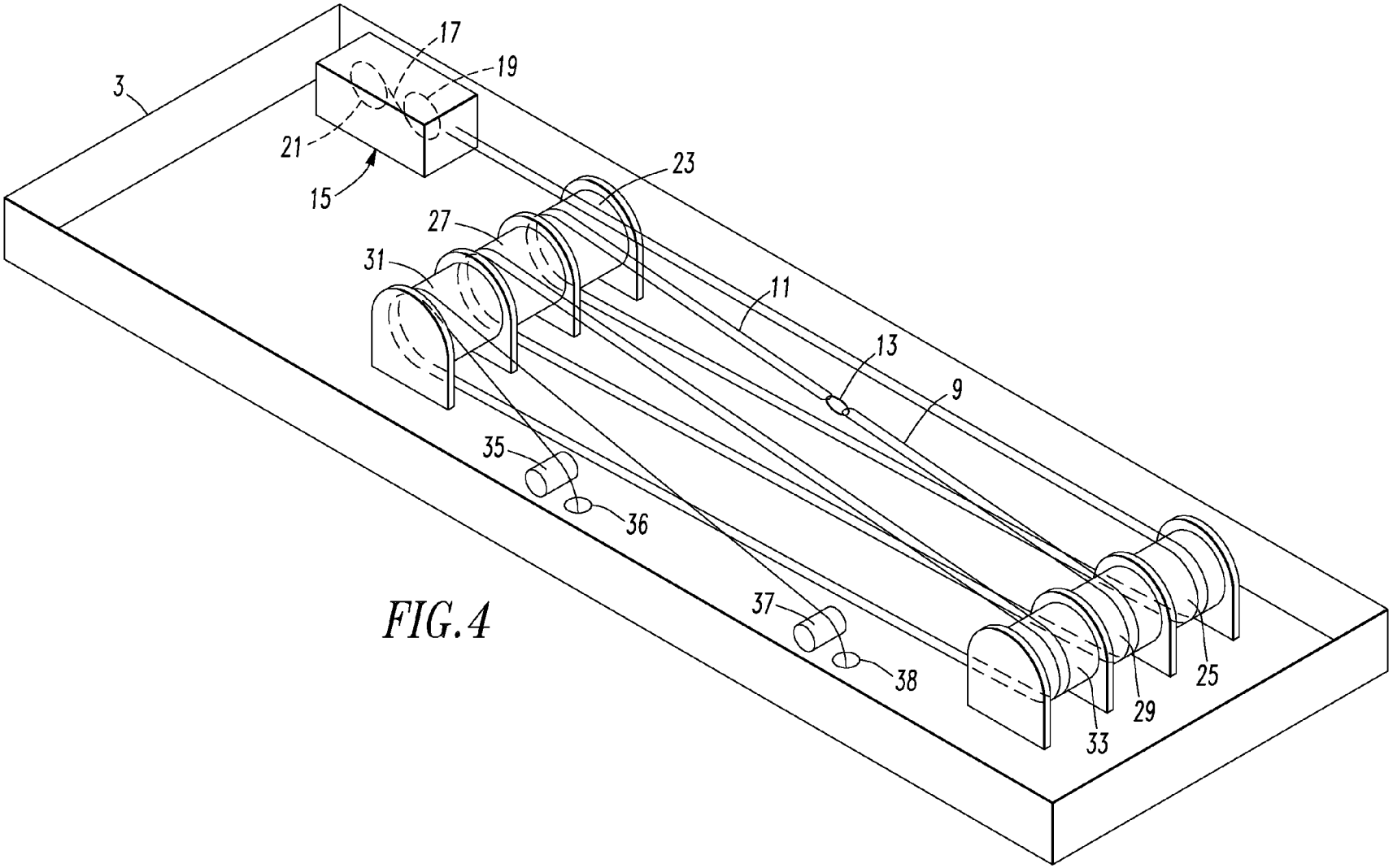
FIG. 4 is a perspective view similar to FIG. 3 illustrating the connector and spring motor cord of the first present preferred embodiment in an initial position that corresponds with the window covering material being in an extended position.
Figure 5:
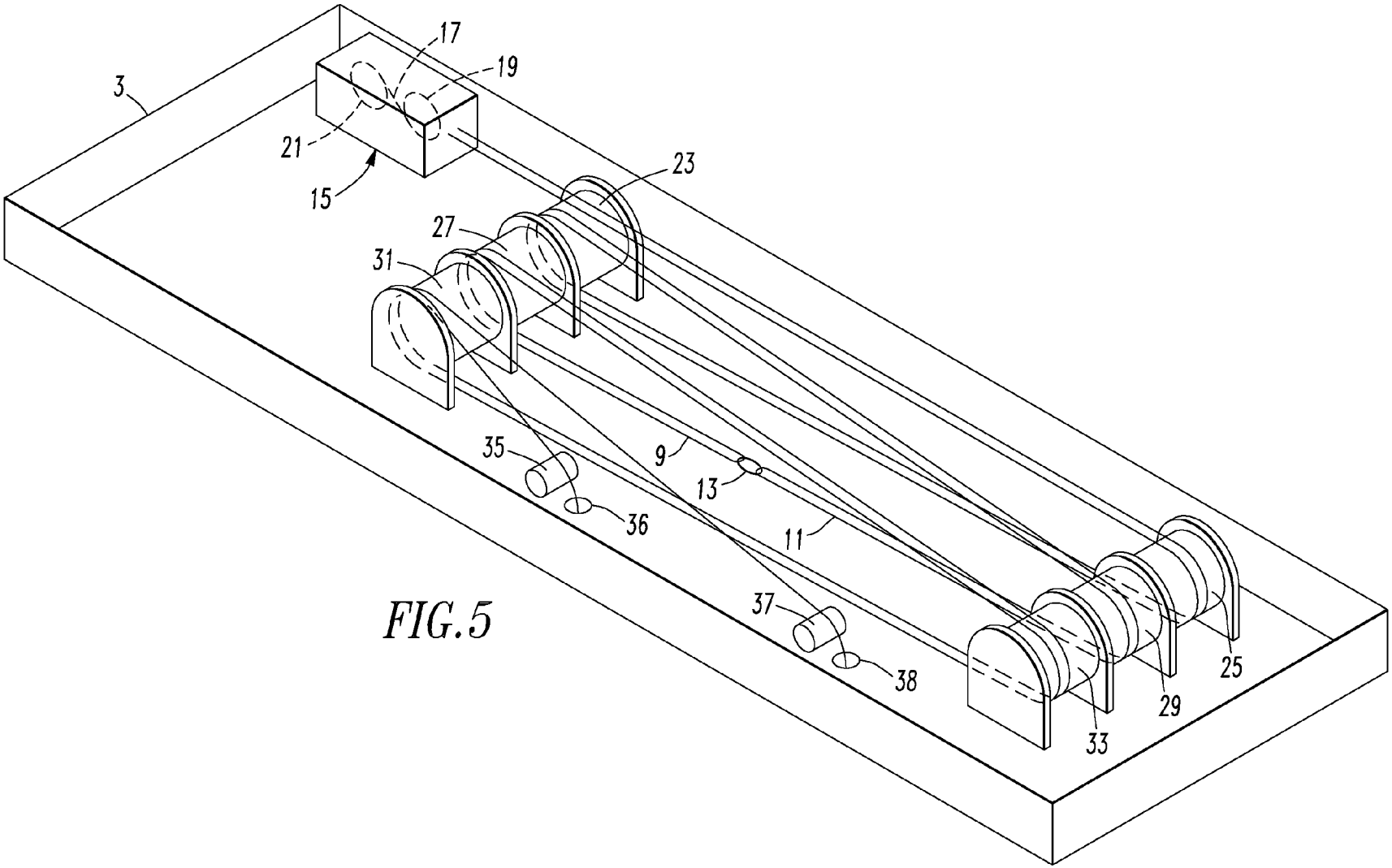
FIG. 5 is a perspective view similar to FIGS. 3 and 4 illustrating the connector and spring motor cord of the first present preferred embodiment in a position that corresponds with the window covering material being in a second extended position.

As shown in FIGS. 3-5, the lift system of the window covering 1 may include a plurality of pulleys adjacent the headrail 3. The pulleys may include a first pulley 23, a second pulley 27 and a third pulley 31 that are all aligned with each other adjacent one end of the headrail. A fourth pulley 25, fifth pulley 29 and sixth pulley 33 may be positioned opposite the first three pulleys 23, 27 and 31 adjacent the opposite end of the headrail 3. Rollers 35 and 37 may be positioned between the pulleys. Each roller 35 and 37 is adjacent a respective hole 36 and 38. A portion of the lift cord 9 passes over the rollers, through the holes 36 and 38 and into the window covering material 7.

The deformable connector 13 is configured such that the deformed connector 13 can pass along pulleys positioned in the headrail 3 of the window covering. For example, a portion of the spring motor cord 11, the deformable connector 13 and a portion of the lift cord 9 may travel from the initial position, which corresponds to the window covering material 7 being in a fully retracted position, to a second position shown in FIG. 4, which corresponds with the window covering material 7 being in an extended position.

In moving from the initial position to the second position, the connector 13, portion of the lift cord 9 and portion of the spring motor cord 11 pass above pulley 23 toward pulley 25. The cord portions and connector 13 then travel along pulley 25 such that the connector 13 and cord portions reverse direction and move toward pulley 23. The connector 13 and cord portions then move along pulley 23 and reverse direction a second time such that the cord portions and connector 13 move toward pulley 29 until stopping at the second position shown in FIG. 4.

The window covering material 7 may also be extended from either the fully retracted position or the extended position to another extended position or a fully extended position as may be appreciated from FIG. 5. When the window covering material 7 is further extended, from the extended position shown in FIG. 4, the connector 13 and portions of spring motor cord 11 and lift cord 9 can move from the second position toward pulley 29, along pulley 29 such that the direction of movement is reversed so that the connector 13 and cord portions move toward pulley 27, along pulley 27 such that the connector 13 and cord portions reverse direction again and move toward pulley 33 before stopping at the position shown in FIG. 5 between pulleys 33 and 27. It should be understood that the connector 13 is configured to move along the cord path and pass along the pulleys during retraction of the window covering material as well.

Figure 6:
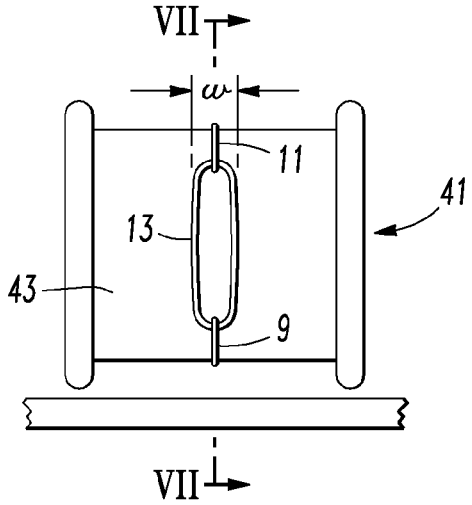
FIG. 6 is a rear elevated perspective view of a first present preferred connector passing over the first present preferred pulley.
Figure 7:
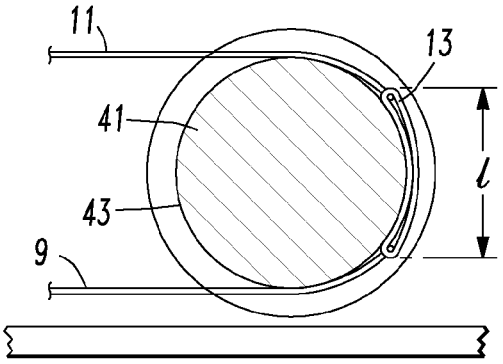
FIG. 7 is a cross sectional view taken along line VII-VII in FIG. 6 of the first present preferred connector passing over the first present preferred pulley.

Because the connector 13 is deformable, the connector 13 may deform to a first deformed configuration when attached to the spring motor cord 11 and lift cord 9 and deform a greater extent when passing over, or passing along, a pulley due to the additional force that may be exerted on the connector 13 from such movement. As may be appreciated from FIGS. 6 and 7, the connector 13 may pass over the surface 43 of a pulley 41, which defines the circumference of the pulley 41. Passing over surface 43 may further deform the connector 13 into a more elongated configuration having a length l, which is longer than length L, and/or a more narrow width w that is narrower than width W. As may be appreciated from FIGS. 6 and 7, the connector 13 may deform as it passes over the pulley 41 such that it has a curved shape or deforms into a curved shape as the connector passes along the surface 43 of the pulley 41.

In some embodiments of my window covering, the connector 13 may have a first deformed state that provides a width W that is about as wide as the width of the pulley surface 43, but is configured to deform to a second width when passing along the pulley 41. Such deformation may make it easier for the connector to pass along the pulley 41 and help ensure that the connector properly aligns with each pulley when traveling along the cord path defined by the pulleys in the lift system. Once the connector 13 has passed along the pulley 41 and no longer engages the surface 43 of the pulley 41, it may become less deformed such that the dimensions of the connector 13 return to the initially deformed length L, and width W.

Embodiments of my window covering may also include other types of lift systems. For example, embodiments of my window covering may include cord operated shades or blinds that include at least one cord lock. For instance, one embodiment of my window covering 51 may include a headrail 53, a bottom rail 55, window covering material 57 positioned between the headrail 53 and bottom rail 55 and lift cords 59 that pass through the window covering material 57 to the headrail 53. The bottom rail 55 may be attached to the window covering material 57 and/or the lift cords 59. A cord lock 61 is positioned adjacent one end of the headrail 53 and has an operator cord 63 that extends from outside the headrail through the cord lock 61 and into the headrail 53.

A number of pulleys may be aligned within the headrail. A first pulley, 71, second pulley 74 and third pulley 78 may be aligned with each other adjacent a first end of the headrail 53 near the cord lock 61. A fourth pulley 73 and fifth pulley 77 may be positioned opposite the first, second and third pulleys 71, 74 and 78 adjacent the other end of the headrail 53. The lift cords 59 pass through holes in the headrail along rollers and around the pulleys to a deformable connector 13. The lift cords 59 are attached to one side of the deformable connector 13. A portion 65 of the operator cord 63 extends through the cord lock 61 and to the deformable connector 13. The portion 65 of the operator cord 63 is attached to the deformable connector 13 at a side that is opposite the side at which the lift cords 59 are attached to the connector 13. The lift cords 59 and operator cord portion 65 may be tied to the connector 13 or otherwise fastened to the connector 13

Figure 9:
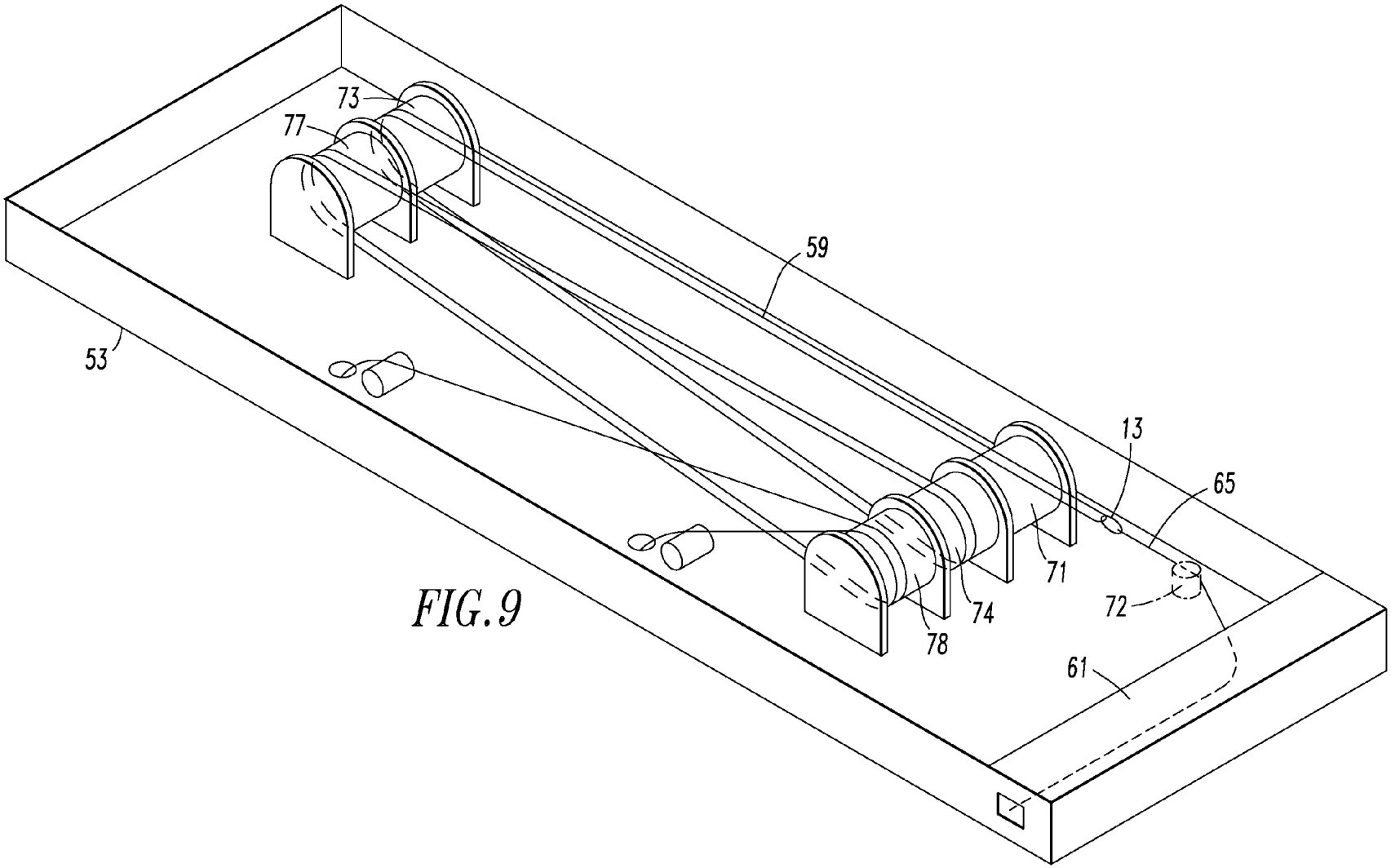
FIG. 9 is a top perspective view of the first present preferred embodiment illustrating the pulleys, spring motor, first present preferred deformable connector and cord path wherein a portion of the cord path is shown in chain line.
Figure 10:
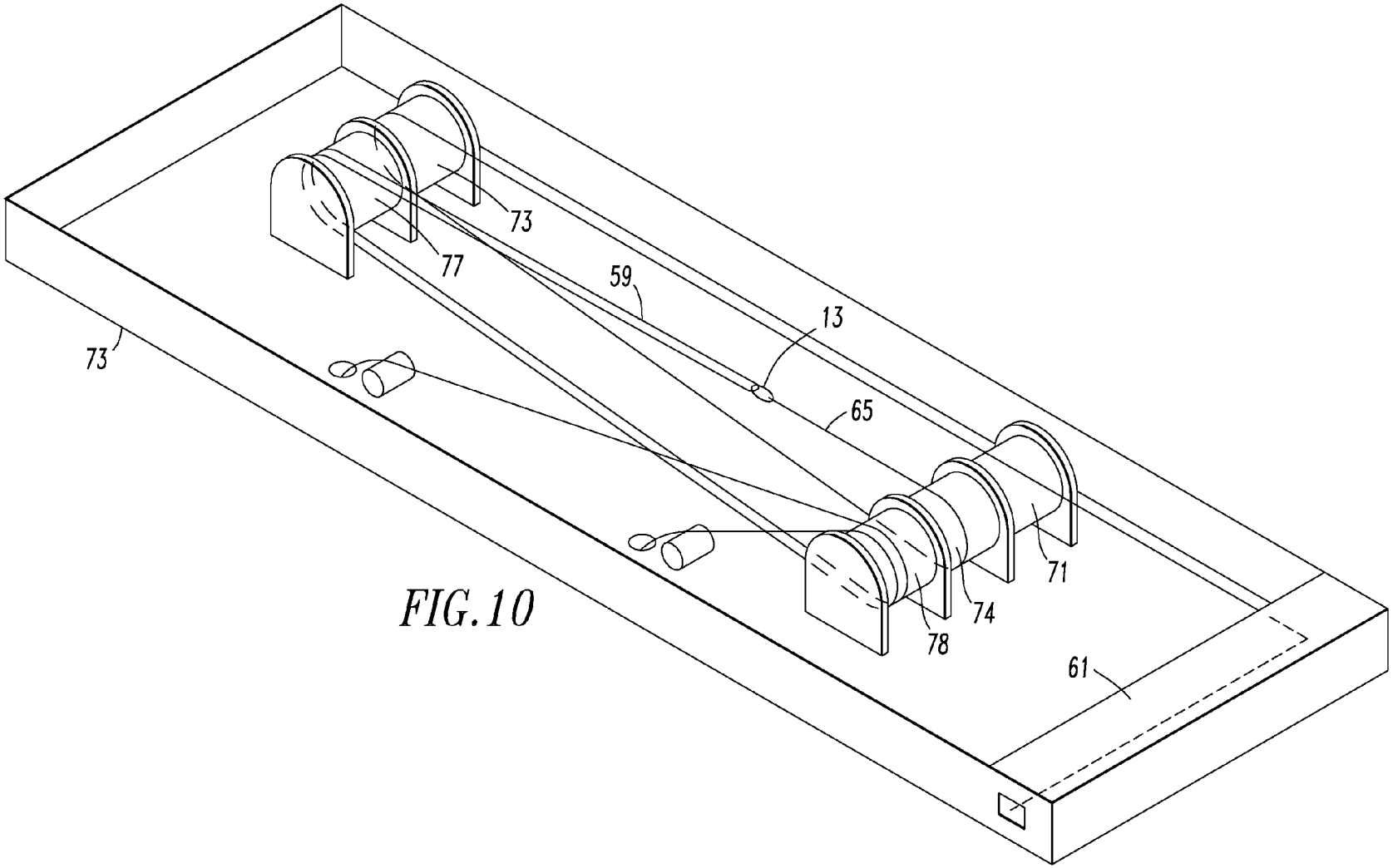
FIG. 10 is a perspective view similar to FIG. 9 illustrating the connector and spring motor cord of the first present preferred embodiment in an initial position that corresponds with the window coveting material being in an extended position.
Figure 11:
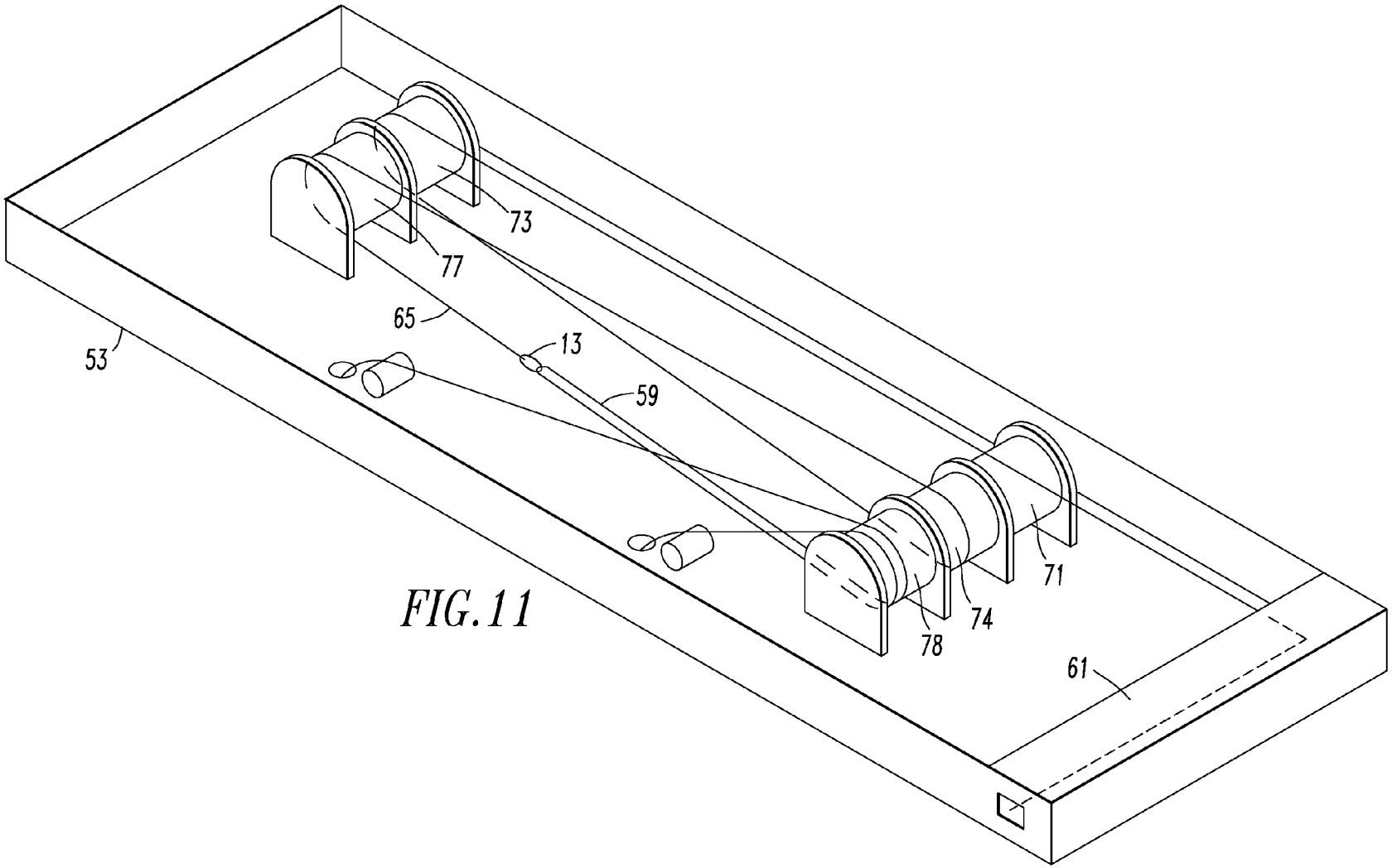
FIG. 11 is a perspective view similar to FIGS. 9 and 10 illustrating the connector and spring motor cord of the first present preferred embodiment in a position that corresponds with the window covering material being in a second extended position.

As may be appreciated from FIGS. 9-11 the connector 13 is sized and configured such the connector 13 deforms sufficiently for it to pass along at least one of the pulleys when the window covering material 57 is being retracted or extended. The connector 13 deforms similarly to the deformation of the connector 13 in the first present preferred embodiment 1, discussed above, and may have a cord path that is defined by the pulleys 71, 73, 74, 77 and 78. The connector 13 may pass along pulleys 71 and 73 when the window covering material 57 is being extended to one of many different extended positions, as illustrated in FIG. 10, or pass along pulleys 71, 73, 74 and 77 when the window covering material 57 is extended to a fully extended position, as illustrated in FIG. 11. It should be understood that one or more posts 72, which are shown in dotted line in FIG. 9, or other structures may also be positioned adjacent the headrail to help define a cord path or a portion of the cord path.

The connector 13 may have an initial size and configuration that is different than its configuration when attached to the spring motor cord 11 or operator cord portion 65 and one or more lift cords. This initial size of the connector may be its undeformed size and configuration, which can include a width dimension that is substantially larger than the width of any pulley. The forces applied to the connector 13 by the one or more lift cords and operator cord portion or spring motor cord preferably provides sufficient force to deform the connector 13 so it at least has a width W. In some embodiments, the width W will be sufficient for the connector 13 to be sized for passing along at least one pulley in the window covering lift system when the window covering is extended from a fully retracted position to a fully extended position. In other embodiments, the width W is sufficient for the connector 13 to pass along multiple pulleys during extension and retraction of the window covering material.

The use of the deformable connector 13 substantially reduces, if not eliminates, the binding problems that can occur in other window covering lift systems that may include a direct attachment, such as a knot, to attach one or more lift cords to a spring motor cord. Moreover, the use of such a connector permits lift systems to be configured so they do not require the collection of lift cords or other cords about any spools or shafts located in or adjacent a headrail or bottom rail, such as the lift systems disclosed in U.S. Pat. No. 2,687,769 or 6,325,131, which can also help avoid any binding or "hang up" problems.

Figure 12:
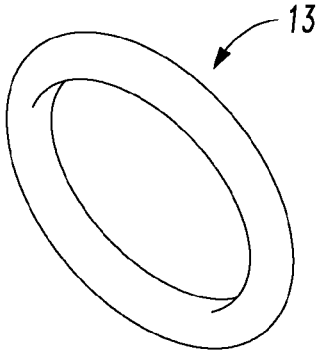
FIG. 12 is a perspective view of the first present preferred deform able connector.
Figure 13:
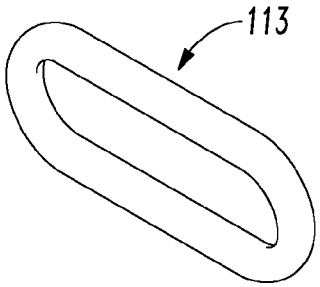
FIG. 13 is a perspective view of a second present preferred deformable connector.
Figure 8:
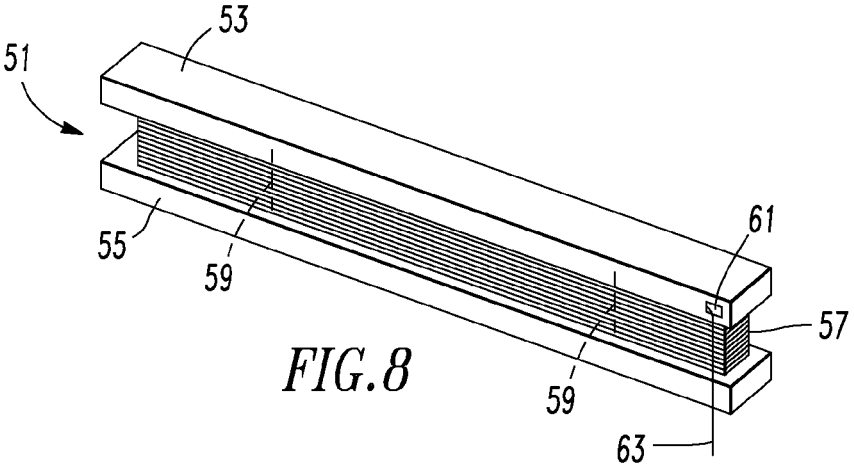
FIG. 8 is a perspective view of a second present preferred embodiment of my window covering illustrating the window covering material in a fully retracted position.

It should be understood that the connector may have various initial shapes or sizes. For example, the connector could be a generally circular ring, such as the connector 13 shown in FIG. 12 or be a generally oval shaped ring, such as ring 113 shown in FIG. 13. The connector may be composed of numerous different deformable materials. Preferably, the connector is composed of rubber, other elastomers or a deformable plastic and is formed as a unitary structure.

Of course, other variations of the present preferred embodiments discussed above may be made. For example, embodiments of my window covering can include pleated shades, cellular shades, venetian blinds, roman shades, top down bottom up shades and other shades or blinds. As another example, embodiments of my window covering can include more than one or two lift cords that extend from the window covering material to the headrail rail. As yet another example, embodiments of my window covering may have the lift system located within the bottom rail.

While certain present preferred embodiments of my window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail, the first rail having a first end and a second end opposite the first end;

window covering material adjacent the first rail, the window covering material moveable from a retracted position to an extended position;

at least one lift cord extending through the window covering material to the headrail;

a plurality of pulleys positioned adjacent the first rail;

at least one lift system adjacent the first rail, at least one lift system cord extending from the at least one lift system, the at least one lift system cord configured to extend away from the at least one lift system along a path defined by at least one of the plurality of pulleys when the window covering material is extended away from the first rail to the extended position and configured to be retracted toward the at least one lift system along the path when the window covering material is retracted from the extended position to the retracted position; and a deformable connector attached to the at least one lift system cord and to the at least one lift cord, the at least one connector sized and configured to deform such that the connector has a size and shape sufficient for the at least one lift system cord, connector and a portion of the at least one lift cord to pass over at least one of the plurality of pulleys during movement along the path; and the connector assuming a curved shape as the connector passes over the at least one of the plurality of pulleys.

2. The window covering of claim 1 wherein the deformable connector is comprised of one of a ring having a generally oval shaped body and ring having a generally circular body.

3. The window covering of claim 1 wherein each pulley has a surface around which the connector passes along when traveling along the path, the deformable connector configured to deform to a first length when the connector is not passing along the surface of any of the pulleys and configured to deform to a second length when the connector passes along the surface of any of the pulleys, the first length being less than the second length.

4. The window covering of claim 1 wherein the first rail is a headrail.

5. The window covering of claim 1 wherein the at least one lift cord is looped about the connector to attach the at least one lift cord to the connector.

6. The window covering of claim 1 wherein the at least one lift system cord is looped about the connector to attach the at least one lift system cord to the connector.

7. The window covering of claim 1 wherein the plurality of pulleys is comprised of a first pulley, a second pulley and a third pulley aligned with each other adjacent the first end of the first rail and a fourth pulley, fifth pulley and sixth pulley aligned with each other adjacent the second end of the first rail.

8. The window covering of claim 7 wherein the path is defined by movement of the at least one lift system cord and the deformable connector to move from adjacent the at least one lift system to the first pulley, from the first pulley to the fourth pulley, from the fourth pulley to the second pulley and from the second pulley to the fifth pulley or the sixth pulley when the window covering material is extended from the retracted position to the extended position.

9. The window covering of claim 1 wherein the plurality of pulleys comprises three pulleys connected to a first pulley mount adjacent the first end of the first rail and three pulleys connected to a second pulley mount adjacent the second end of the first rail.

10. The window covering of claim 1 wherein the at least one lift system cord, connector and a portion of the at least one lift cord pass along at least one of the plurality of pulleys during movement along the path such that movement of the at least one lift system cord and connector is reversed from movement toward the first end of the first rail to movement toward the second end of the first rail while moving along the path when the window covering material is retracted from the extended position to the retracted position or extended from the retracted portion to the extended position.

11. The window covering of claim 1 wherein the lift system is comprised of a cord lock adjacent the first rail and wherein the at least one lift system cord is comprised of at least one operator cord passing through the cord lock.

12. The window covering of claim 1 wherein the lift system is comprised of a spring motor and the at least one lift system cord is at least one spring motor cord.

13. The window covering of claim 1 further comprising a second rail attached to at least one of the at least one lift cord and the window covering material.

14. The window covering of claim 13 wherein the second rail is a bottom rail.

15. The window covering of claim 14 wherein the first rail is a headrail.

* * * * *